US005403541A

United States Patent [19]

Oskarsson et al.

[11] Patent Number: 5,403,541

[45] Date of Patent: Apr. 4, 1995

[54] METHOD OF MAKING A SINTERED INSERT

[75] Inventors: Rolf G. Oskarsson, Ronninge; Gerold Weinl, Alvsjo; Ake Östlund, Taby, all of Sweden

[73] Assignee: Sandvik AB, Sandviken, Sweden

[21] Appl. No.: 878,986

[22] Filed: May 6, 1992

[30] Foreign Application Priority Data

May 7, 1991 [SE] Sweden ..... 9101386

[51] Int. Cl.[6] ..... B22F 3/12; B22F 9/04

[52] U.S. Cl. ..... 419/13; 419/15; 419/16; 419/17; 419/18; 419/33; 419/38; 75/238; 75/242

[58] Field of Search ..... 75/238, 239, 240, 242, 75/241, 244; 419/13, 15, 23, 32, 38, 16, 17, 18, 33

[56] References Cited

U.S. PATENT DOCUMENTS

| | | | |
|---|---|---|---|
| 3,971,656 | 7/1976 | Rudy | 75/203 |
| 4,049,876 | 9/1977 | Yamamoto et al. | 428/932 |
| 4,120,719 | 10/1978 | Nomura et al. | 75/258 |
| 4,769,070 | 9/1980 | Tobioka et al. | 75/238 |
| 4,966,627 | 10/1990 | Keshaven et al. | 75/240 |
| 5,110,349 | 5/1992 | Westergren et al. | 75/233 |
| 5,110,543 | 5/1992 | Odani et al. | 419/29 |

FOREIGN PATENT DOCUMENTS

| | | |
|---|---|---|
| 0417302 | 3/1991 | European Pat. Off. . |
| 61-295352 | 5/1987 | Japan . |
| 62-237740 | 6/1989 | Japan . |

OTHER PUBLICATIONS

Patent Abstracts of Japan vol. 013, No. 111 (C-577) 16 Mar. 1989 & JP-A-63 286 549 (Toshiba Tungalloy Co Ltd) 19 May 1987.

Patent Abstracts of Japan vol. 012, No. 213 (C-505) 17 Jun. 1988 & JP-A-63 011 645 (Sumitomo Electric Ind Ltd) 19 Jan. 1988.

Patent Abstracts of Japan vol. 014, No. 294 (C-732) 26 Jun. 1990 & JP-A-20 93 036 (Kyocera Corp) 3 Apr. 1990.

*Primary Examiner*—Ngoclan T. Mai

*Attorney, Agent, or Firm*—Burns, Doane, Swecker & Mathis

[57] ABSTRACT

Method of making sintered insert for milling and turning formed of a titanium-based carbonitride containing hard constituents and binder phase metal comprising milling at least one hard constituent with binder phase metal, adding a second hard constituent at a later time during milling, pressing and sintering the pressed constituents to form the insert.

1 Claim, 1 Drawing Sheet

METHOD OF MAKING A SINTERED INSERT

BACKGROUND OF THE INVENTION

The present invention relates to a sintered carbonitride alloy having titanium as main component intended for use as an insert for turning and milling with improved wear resistance without an accompanying decrease in toughness.

Classic cemented carbide, i.e., based upon tungsten carbide (WC) and cobalt (Co) as binder phase, has in the last few years met with increased competition from titanium-based hard materials, usually called cermets. In the beginning these titanium-based alloys were based on TiC+Ni and were used only for high speed finishing because of their extraordinary wear resistance at high cutting temperatures. This property depends essentially upon the good chemical stability of these titanium-based alloys. The toughness behavior and resistance to plastic deformation were not satisfactory, however, and therefore the area of application was relatively limited.

Development proceeded and the range of application for sintered titanium-based hard materials has been considerably enlarged. The toughness behavior and the resistance to plastic deformation have been considerably improved. This has been done, however, by partly sacrificing the wear resistance.

An important development of titanium-based hard alloys is the substitution of carbides by nitrides in the hard constituent phase. This decreases the grain size of the hard constituents in the sintered alloy. Both the decrease in grain size and the use of nitrides lead to the possibility of increasing the toughness at unchanged wear resistance. Characteristic for said alloys is that they are usually considerably more fine-grained than normal cemented carbide, i.e., WC-Co-based hard alloy. Nitrides are also generally more chemically stable than carbides which results in lower tendencies to stick to work piece material or wear by solution of the tool, the so-called diffusion wear.

In the binder phase, the metals of the iron group, i.e., Fe, Ni and/or Co, are used. In the beginning, only Ni was used, but nowadays both Co and Ni are often found in the binder phase of modern alloys. The amount of binder phase is generally 3–25% by weight.

Besides Ti, the other metals of the groups IVa, Va and VIa, i.e., Zr, Hf, V, Nb, Ta, Cr, Mo and/or W, are normally used as hard constituent formers as carbides, nitrides and/or carbonitrides. There are also other metals used, for example Al, which sometimes are said to harden the binder phase and sometimes improve the wetting between hard constituents and binder phase, i.e., facilitate the sintering.

A very common structure in alloys of this type is hard constituent grains with a core-rim-structure. An early patent in this area is U.S. Pat. No. 3,971,656 which comprises Ti- and N-rich cores and rims rich in Mo, W and C.

It is known through U.S. patent application Ser. No. 07/543,474 (our reference: 024000-757), which is herein incorporated by reference, that at least two different combinations of duplex core-rim-structures in well-balanced proportions give optimal properties regarding wear resistance, toughness behavior and/or plastic deformation.

When using inserts of sintered carbonitride in turning and milling, the inserts are worn. On the rake face (that is, that face against which the chips slide) so-called crater wear is obtained where the chip comes in contact with the insert. In connection herewith, a crater is formed which successively increases in size and gradually leads to insert failure. On the clearance face, that face which slides against the work piece, so-called flank wear is obtained which means that material is worn away and the edge changes its shape. A characteristic property for titanium-based carbonitride alloys compared to conventional cemented carbide is the good resistance against flank wear. Decisive for the tool life is therefore most often crater wear and how this crater moves toward the edge whereby finally crater breakthrough takes place which leads to total failure.

OBJECTS AND SUMMARY OF THE INVENTION

It is an object of this invention to avoid or alleviate the problems of the prior art.

It is particularly an object of this invention to provide an insert for milling and turning of a titanium-based carbonitride alloy which has increased resistance to wear on the rake face of the insert.

In one aspect of the invention there is provided a sintered insert for milling and turning comprising a titanium-based carbonitride alloy containing hard constituents based on Ti, Zr, Hf, V, Nb, Ta, Cr, Mo and/or W and 3–25% binder phase based on Co and/or Ni, the bottom of a crater caused by crater wear during milling and turning on the rake face of said insert containing grooves with a mutual distance between their peaks of 40–100 μm and the depth of most of the grooves being >12 μm.

In another aspect of the invention there is provided a method of making a sintered insert for milling or turning comprising a titanium-based carbonitride containing hard constituents based on Ti, Zr, Hf, V, Nb, Ta, Cr, Mo and/or W and 3–25% binder phase based on Co an/or Ni wherein at least one hard constituent and binder phase metal are milled, a second hard constituent is added at a later time during the milling, the milled powders are pressed and sintered to form the insert.

In still another aspect of the invention there is provided a method of cutting a metal workpiece by milling and turning with a sintered insert, the improvement comprising using a sintered insert for milling and turning comprising a titanium-based carbonitride alloy containing hard constituents based on Ti, Zr, Hf, V, Nb, Ta, Cr, Mo and/or W and 3–25% binder phase based on Co and/or Ni, the bottom of a crater caused by crater wear during milling and turning on the rake face of said insert containing grooves with a mutual distance between their peaks of 40–100 μm and the depth of most of the grooves being >12 μm.

DETAILED DESCRIPTION OF THE PREFERRED EMBODIMENTS OF THE INVENTION

It has now turned out that it is possible to increase the level of performance by manufacturing the material such that relatively coarse, well-developed grooves are formed in the bottom of the crater which is formed during machining as a result of the wear. With this structure, the wear resistance can be increased without a corresponding decrease of the toughness behavior. As a consequence, a changed wear mechanism is obtained. On one hand, the wear pattern of the rake face is changed with a decreased tendency to clad to work piece material. On the other hand, the movement of the resulting wear crater toward the cutting edge is considerably retarded. This retardation is much greater than what is to be expected form the depth of the crater.

Figure 4:
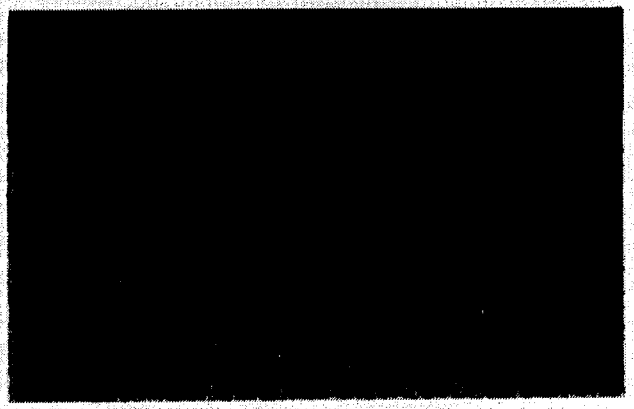
FIG. 4 is a cross-section in 300× of the grooves of a titanium-based carbonitride alloy insert made according to the present invention.
Figure 2:
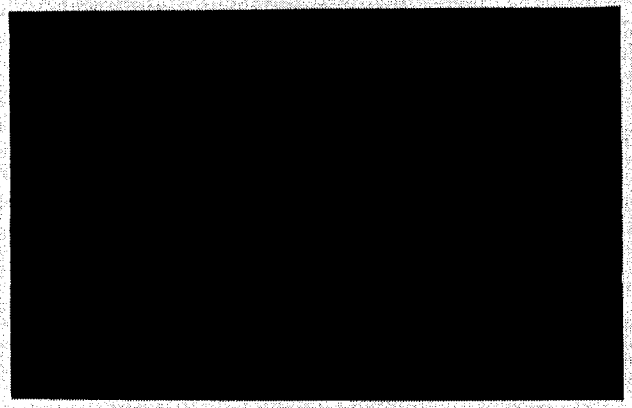
FIG. 2 shows the crater wear in 60× for an insert made according to the present invention.

The titanium-based carbonitride alloy according to the present invention is thus characterized in that the bottom of the crater obtained due to crater wear consists of coarser, more well-developed grooves, compare FIG. 4 to that of known material, FIG. 2. The distance between the peaks of the grooves according to the present invention is 40–100 μm, preferably 50–80 μm, and the main part, preferably 75%, most preferably 90%, shall have a height >12 μm, preferably >15 μm. This type of wear is most pronounced when dry milling a low carbon steel with a Brinell hardness of 150–200 at a cutting speed of 200–400 m/min and a feed of 0.05–0.2 mm/tooth.

A material with a wear pattern according to the invention is obtained if it is manufactured by powder metallurgical methods such that it contains a grain size fraction with coarser grains of 2–8 μm, preferably 2–6 μm, mean grain size in a matrix of more normal mean grain size, <1 μm and such that the difference in mean grain size between the both fractions is preferably >1.5 μm, most preferably >2 μm. A suitable volume fraction of the coarser grains is 10–50%, preferably 20–40%. The powdery raw materials can be added as single compound, e.g., TiN, or complex compound, e.g., (Ti,Ta,V)(C,N). The desired 'coarse grain material' can also been added after a certain part of the total milling time. By doing so, the grains which shall give the extra wear resistance contribution are not milled for as long a time. If this material has good resistance against mechanical disintegration, it is even possible to use a raw material that does not have coarser grain size than the rest of the raw materials but nevertheless gives a considerable contribution to increased grain size of the desired material. The 'coarse-grain material' can consist of one or more raw materials. It can even be of the same type as the fine grain part.

It has turned out to be particularly favorable if a raw material such as Ti(C,N), (Ti,Ta)C, (Ti,Ta)(C,N) and/or (Ti,Ta,V)(C,N) is added as coarser grains because such grains have great resistance against disintegration and are stable during the sintering process, i.e., have low tendency to dissolution.

The invention is additionally illustrated in connection with the following Examples which are to be considered as illustrative of the present invention. It should be understood, however, that the invention is not limited to the specific details of the Examples.

EXAMPLE 1

A powder mixture with a total composition of (Ti,W,Ta,Mo)(C,N) and (Co,Ni) binder phase starting from different raw materials such as: Ti(C,N), (Ti,Ta)(C,N), WC, $Mo_2C$, and (Ti,Ta)C was manufactured of the following composition in % by weight: 15 W, 39.2 Ti, 5.9 Ta, 8.8 Mo, 11.5 Co, 7.7 Ni, 9.3 C, and 2.6 N.

The powder was mixed in a ball mill. All raw materials were milled from the beginning and the milling time was 33 hours (Variant 1).

Another mixture was manufactured according to the present invention with identical composition but with the difference that the milling time for Ti(C,N) was reduced to 25 hours (Variant 2).

Milling inserts of type SPKN 1203EDR were pressed of both mixtures and were sintered under the same condition. The mean grain size of Variant 1 after sintering was 0.9 μm while the grain of Variant 2 after sintering was 0.9 μm and 3.0 μm respectively. Variant 2 obtained a considerably greater amount of coarse grains due to the shorter milling time for Ti(C,N) than in Variant 1.

Both variants were tested in a basic toughness test as well as in a wear resistance test. The relative toughness expressed as the feed where 50% of the inserts had gone to fracture was the same for both variants.

Figure 3:
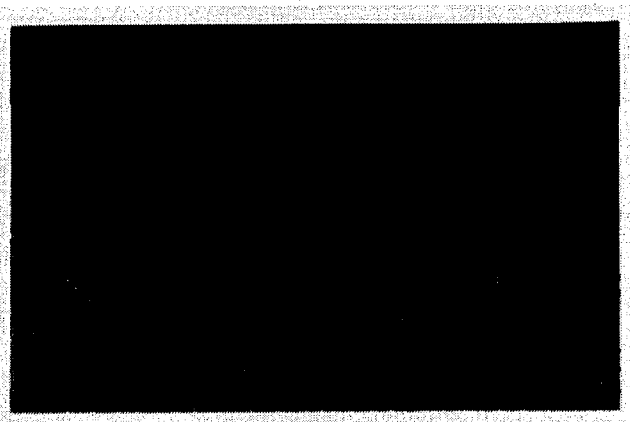
FIG. 3 is a cross-section in 300× of the grooves of a titanium-based carbonitride alloy insert made according known techniques.
Figure 1:
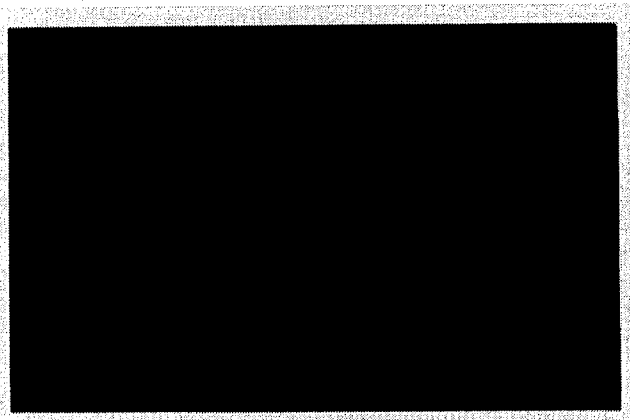
FIG. 1 shows the crater wear in 60× for an insert made according to conventional techniques.

A wear resistance test was thereafter performed with the following data:

Work piece material: SS1672
Speed: 285 m/mm
Table Feed: 87 mm/mm
Tooth Feed: 0.12 mm/insert
Cutting Depth: 2 mm The wear for both variants was measured continuously. It turned out that the resistance to flank wear was the same for both variants whereas the resistance to crater wear, measured as the depth of the crater, KT, was 20% better for Variant 2. The crater resulting from the crater wear had in Variant 2 coarser, more well-developed grooves with a mutual distance between their peaks of 64 μm and with ~70% of the grooves having a depth of >15 μm, FIGS. 2 and 4, than Variant 1, FIGS. 1 and 3 with a mutual distance between their peaks of 42 μm and with ~10% of the grooves having a depth of >15 μm.

Due to the changed wear mechanism for inserts according to the present invention, the measured KT-values do not give sufficient information about the ability to counteract the move of the crater toward the edge. It is, however, this mechanism that finally decides the total life, i.e., the time to crater breakthrough.

In an extended wear test, i.e., determination of the time until the inserts have been broken, performed as 'one tooth milling' with the above cutting data it turned out that there is a greater difference in tool life between the variants than indicated by the KT-values. Variant 1 had a mean life of 39 minutes (which corresponds to a milled length of 3.4 m) whereas the mean tool life of Variant 2 was 82 minutes corresponding to a milled length of 7.2 m, i.e., an improvement of >2 times.

EXAMPLE 2

A powder mixture with a total composition of (Ti,W,Ta,Mo,V)(C,N) and (Co,Ni) binder phase starting from different raw materials such as Ti(C,N), (Ti,Ta)C, $Mo_2C$, WC and VC was manufactured with the following composition in % by weight: 14.9 W, 38.2 Ti, 5.9 Ta, 8.8 Mo, 3.2 V, 10.8 Co, 5.4 Ni, 8.4 C, and 4.4 N.

The powder was mixed in a ball mill. All raw materials were milled from the beginning and the milling time was 38 hours (Variant 1).

Another mixture according to the invention was manufactured with identical composition but with the difference that the milling time for only the Ti(C,N) raw material was reduced to 28 hours (Variant 2). All other compounds were milled 38 hours.

Turning inserts of type TNMG 160408 QF were pressed of both mixtures and were sintered at the same occasion. Even in this case, a considerable difference in grain size could be observed. The mean grain size of Variant 1 after sintering was 0.8 μm while the grain of Variant 2 after sintering was 0.8 μm and 3.5 μm respectively.

Technological testing with regard to basic toughness showed no difference at all between the variants. On the other hand, the same observation as in the previous Example could be done, i.e., a retardation of the growth of the crater toward the edge. The following cutting data were used:

Work piece material: SS2541
Speed: 315 m/min
Feed: 0.15 mm.rev
Cutting Depth: 0.5 mm The mean tool life for Variant 2 was 18.3 minutes which is 60% better than Variant 1 which worked in the average 11.5 minutes. In all cases, crater breakthrough was life criterium. The flank wear resistance was the same for both variants. The depth of the crater wear, KT, could not be determined due to the chip breaker.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of making a sintered insert for milling or turning comprising a titanium-based carbonitride containing hard constituents based on a metal taken from the group consisting of Ti, Zr, Hf, V, Nb, Ta, Cr, Mo, W and mixtures thereof and 3–25% binder phase based on a metal taken from the group consisting of Co, Ni and mixtures thereof, wherein at least one hard constituent and binder phase metal are milled, a second hard constituent is added at a later time during the milling, the milled powders are pressed and sintered to form the insert.

* * * * *